US011391535B2

(12) United States Patent
Begins

(10) Patent No.: US 11,391,535 B2
(45) Date of Patent: Jul. 19, 2022

(54) FIREARM BARREL CLEANING SYSTEM

(71) Applicant: Paul N. Begins, Kenai, AK (US)

(72) Inventor: Paul N. Begins, Kenai, AK (US)

( * ) Notice: Subject to any disclaimer, the term of this patent is extended or adjusted under 35 U.S.C. 154(b) by 122 days.

(21) Appl. No.: 16/551,661

(22) Filed: Aug. 26, 2019

(65) Prior Publication Data

US 2021/0063109 A1 Mar. 4, 2021

(51) Int. Cl.
*B08B 9/032* (2006.01)
*F41A 29/00* (2006.01)

(52) U.S. Cl.
CPC ..... *F41A 29/00* (2013.01); *B08B 9/0322* (2013.01); *B08B 9/0326* (2013.01); *B08B 2209/005* (2013.01); *B08B 2209/032* (2013.01)

(58) Field of Classification Search
CPC ..... B08B 9/027; B08B 9/032; B08B 9/0321; B08B 9/0322; B08B 9/0326; B08B 9/0327; B08B 9/0328; B08B 2209/005; B08B 2209/027; B08B 2209/032; F41A 13/04; F41A 29/00
USPC ..... 42/95
See application file for complete search history.

(56) References Cited

U.S. PATENT DOCUMENTS 1,719,933 A 7/1929 Huff
2,606,567 A * 8/1952 Cooper ..... F41A 29/00 134/99.1
4,404,979 A 9/1983 Hobbs
5,095,644 A * 3/1992 McCoy ..... F41A 29/00 42/95
5,202,523 A 4/1993 Grossman et al.
6,227,462 B1 * 5/2001 Chen ..... B60S 1/487 239/135
7,073,286 B2 7/2006 Paananen et al.
7,594,463 B2 9/2009 Skinner
(Continued)

FOREIGN PATENT DOCUMENTS

KR 20030041357 A * 5/2003
WO WO-9533174 A1 * 12/1995 ..... F41A 29/00
(Continued)

OTHER PUBLICATIONS

KR20030041357—Machine Translation (Year: 2003).*
(Continued)

*Primary Examiner* — Marc Lorenzi
(74) *Attorney, Agent, or Firm* — Nath, Goldberg & Meyer; Richard C. Litman

(57) ABSTRACT

The firearm barrel cleaning system selectively cycles a stream of ultrasonic cleaning fluid through the barrel of a firearm, and further selectively ultrasonically induces cavitation within the cleaning fluid in the barrel for ultrasonic cleaning. The firearm barrel cleaning system includes a receiver assembly having a first end adapted for receiving the stream of cleaning fluid and a second end is adapted for insertion into the firearm receiver and sealing against a first end of the barrel to eject the stream of cleaning fluid into the barrel. A cap structure, having an outlet hose connector is clamped over the muzzle end of the barrel of the firearm. A pump selectively circulates the cleaning fluid through the receiver assembly, the barrel and out through the cap structure. An ultrasonic transducer is mounted on the receiver assembly for selectively inducing cavitation in the cleaning fluid.

9 Claims, 7 Drawing Sheets

(56) References Cited

U.S. PATENT DOCUMENTS

| | | | | |
|---|---|---|---|---|
| 2007/0039224 | A1* | 2/2007 | Skinner | F41A 29/00 42/106 |
| 2014/0338701 | A1* | 11/2014 | Freytag | F41A 29/02 134/8 |
| 2017/0045322 | A1* | 2/2017 | Fiedorowicz | F41A 13/10 |
| 2017/0175569 | A1* | 6/2017 | Rawson | F01D 25/002 |

FOREIGN PATENT DOCUMENTS

| | | | | |
|---|---|---|---|---|
| WO | 2009150674 | | 12/2009 | |
| WO | WO-2010049588 | A1 * | 5/2010 | F41A 29/00 |
| WO | 2014037309 | | 3/2014 | |

OTHER PUBLICATIONS

"How to Maintain Firearms with an Ultrasonic Cleaner"; printed from https://www.tovatech.com/blog/25925/ultrasonic-cleaner/maintain-firearms-ultrasonic-cleaner on Jul. 15, 2019.

* cited by examiner

FIREARM BARREL CLEANING SYSTEM

BACKGROUND

1. Field

The disclosure of the present patent application relates to firearm accessories, and particularly to a firearm barrel cleaning system that uses an ultrasonic cleaning system for cleaning the barrel of a firearm.

2. Description of the Related Art

Firearm operation involves ignition of an explosive charge within the firearm chamber, followed by the exit from the chamber of a projectile at high speed, which passes through and exits the barrel of the firearm. The explosive process inherent in firearms results in the accumulation of debris and residue within the chamber and barrel. Modern firearms have spiral or helical grooves (referred to as rifling) in the bore of barrel of the firearm to improve the range and accuracy of the shell. The accumulation of such debris and residue from expended shells can inhibit proper operation of the firearm, including misfires, damage to the firearm, possible injury to the user, and deterioration of the range and accuracy of the weapon. Thus, regular cleaning is always recommended to the owners and operators of firearms.

Conventional cleaning is typically performed as a manual process involving breaking down of the firearm, followed by rubbing a cleaning patch saturated with an appropriate solvent against the various surfaces of the firearm. After use, the patches are then discarded, which presents difficulties in disposal, since the dirty patches typically contain both lead and often toxic cleaning solvents. Further, while cleaning the barrel, the cleaning patch is typically driven down the barrel by a rod, to be rubbed against the barrel walls, which can be extremely difficult to manipulate, and in some cases, can cause the patch to become lodged or packed within the barrel.

As mentioned above, rifle and pistol barrels include "rifling", which is, typically, five or six grooves spiraling down the barrel interior to spin-stabilize the bullet after it is fired from the cartridge and accelerates down the barrel. These groove areas are most prone to powder residue and fouling. Some types of fouling, such as copper from jacketed bullets, are difficult to remove, even with strong solvents, and some types of conventional cleaning solutions can damage the barrel itself. As discussed above, cleaning is typically performed by running a patch through the barrel with a jag on a cleaning rod. This may be replaced by, or used in combination with, the similar process of using a conventional bore brush with a cleaning fluid. When the patch runs through the barrel with little or no discoloration, the firearm is considered clean and a final lubricating patch is run through to prevent barrel corrosion. However, due to the difficulty inherent in cleaning the rifling of the barrel, cleaning with the patch and/or a bore brush may require up to an hour or more of repeated manual cleaning to fully clean the barrel. Even then, the barrel may not be fully clean, as a "clean" patch may simply indicate that the patch and/or brush, along with the selected cleaning fluid, have performed to the level of their abilities, rather than the barrel being completely clean. Thus, a firearm barrel cleaning system solving the aforementioned problems is desired.

SUMMARY

The firearm barrel cleaning system selectively cycles a stream of ultrasonic cleaning fluid through the barrel of a firearm, such as the barrel of a rifle or a revolver, and periodically pauses fluid flow and activates an ultrasonic transducer to induce cavitation within the cleaning fluid in the barrel for ultrasonic cleaning of the interior of the barrel. An embodiment of the firearm barrel cleaning system for use with a rifle having a bolt includes a receiver assembly having opposed first and second ends, the first end being adapted for receiving the stream of cleaning fluid, and the second end being adapted for insertion into the rifle receiver after removal of the bolt to bias a nozzle against the bore defined in the barrel of the firearm to eject the stream of cleaning fluid within the barrel.

A cap structure having a hose connector is adapted for releasably sealing the muzzle end of the barrel of the firearm to seal the cleaning fluid in the barrel during the ultrasonic cleaning cycle(s). A pump selectively circulates the cleaning fluid through the receiver assembly, the barrel, and out through the hose connector of the cap structure. An ultrasonic transducer is mounted on the receiver assembly for selectively inducing cavitation in the cleaning fluid when fluid flow is paused.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
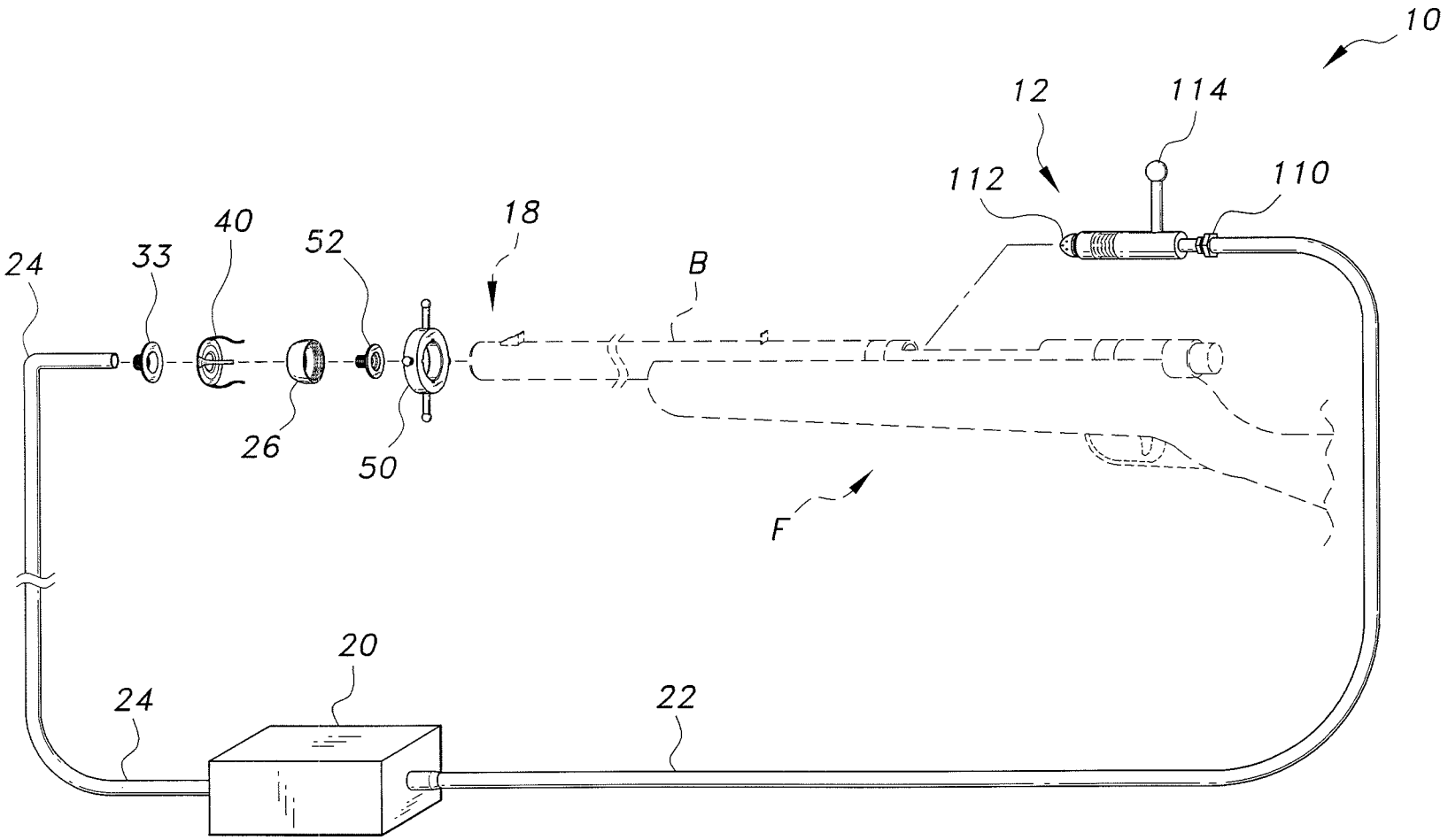
FIG. 1 is a partially exploded, environmental perspective view of a firearm cleaning system.

As shown in FIG. 1, an embodiment of the firearm barrel cleaning system 10 for cleaning a rifle having a bolt includes a receiver assembly 12 adapted for insertion into the receiver of the rifle after removal of the bolt, the assembly 12 having an interchangeable nozzle 112 adapted for being sealed against the opening of the rifle bore defined in the barrel B of the firearm F by a spring-loaded housing assembly having a handle 114 cooperating with the rifle receiver, and a cap structure for sealing the muzzle end 18 of the barrel B. The receiver assembly 12 is in fluid communication with a pump 20 via an injection tube 22, and the cap structure is also in fluid communication with the pump 20 via return tube 24. The pump 20 may be any suitable type of pump for cycling an ultrasonic cleaning fluid through the injection tube 22, receiver assembly 12, barrel B, cap structure and return tube 24. It will be understood that the pump 20 may have an integral recirculation tank for supplying ultrasonic cleaning fluid for introduction into the barrel and a filtration system for receiving and cleaning fluid returned to the pump, and that the pump 20 may be a pulse-type ultrasonic recirculation pump. When the receiver assembly 12 is inserted into the rifle receiver and the nozzle 112 is spring-biased against the bore of the barrel B, the pump 20 selectively injects the ultrasonic cleaning fluid into the bore of the barrel B, preferably in a laminar flow, and also removes the used ultrasonic cleaning fluid from within barrel B through the cap structure (when placed on and around the muzzle end 18 of the barrel B) via return tube 24. Although the firearm F is shown as a rifle in FIG. 1, it should be understood that firearm F, and its associated barrel B, are shown for exemplary purposes only, and that the firearm barrel cleaning system 10 may be used with any other suitable type of firearm, such as a revolver, by replacing the receiver assembly 12 with a suitable receiver adapter.

Figure 2:
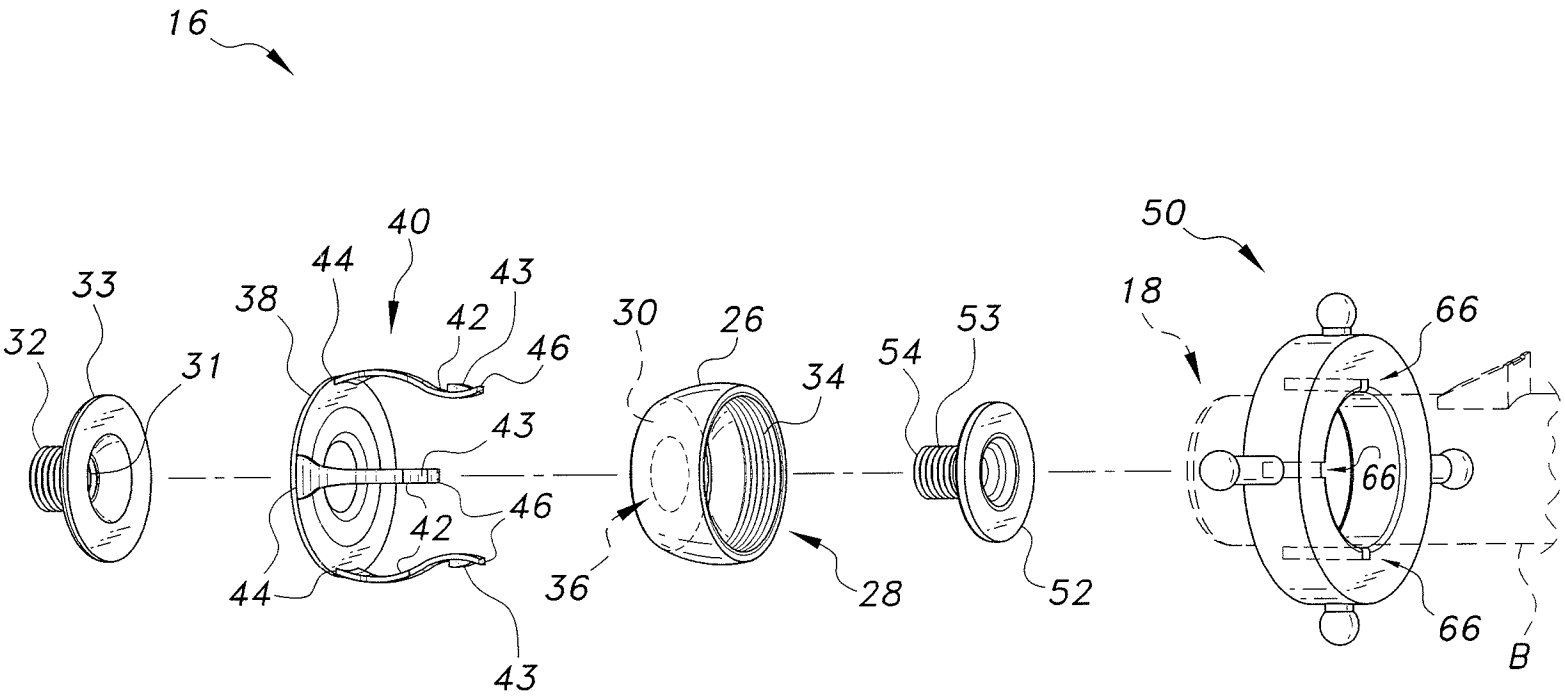
FIG. 2 is an exploded perspective view of a cap structure of the firearm cleaning system, the cap structure sealing the muzzle and crown of the firearm.

As best seen in FIG. 2, the cap structure 16 for sealing the muzzle end 18 of the barrel B includes a housing 26 having an open end 28 and an opposed partially closed end 30. The open end 28 of the housing 26 is adapted for mounting on the muzzle end 18 of the barrel B. Texturing or internal threading 34 may be formed on an inner surface of the housing 26 adjacent the open end 28, as shown, for gripping the barrel B. The housing 26 may be formed from any suitable type of material. For example, housing 26 may be formed from Delrin®, a thermoplastic manufactured by DuPont Polymers, Inc. of Delaware, or from a natural or synthetic rubber.

A ring portion 38 of a clamp 40 may be sized to abut the partially closed end 30 of the housing 26. Although it should be understood that any suitable type of clamp or clamping member may be used, in the example of FIG. 2, the clamp 40 includes a plurality of arms 42 (with three such arms 42 shown in FIG. 2), each having a fixed end 44 and a free end 46. The arms 42 may be resilient for tensioning the arms 42 against the housing 26 when the housing 26 is mounted on the barrel B and the clamp 40 is mounted on the housing 26. Further, a flanged outlet tube 54 may be inserted within the cover 26. The flange 52 of the outlet tube 54 is configured to mate against an inner surface of the closed end 30 with the barrel 53 of the tube 54 projecting through an aperture 36 formed in the closed end 30 of the housing 26. The outlet tube 54 may incorporate a check valve or other one-way valve to prevent outflow when the pump 20 is shut off.

As shown in FIG. 2, the barrel 53 of the flanged outlet tube 54 also extends through an aperture formed in the ring portion 38 of the clamp 40. The barrel 53 of the outlet tube 54 may be externally threaded. A hose connector 33 may have a serrated nipple 32 (which may be tapered for receiving tubing having different internal diameters) for connection to the return tubing 24 and may have complementary internal threads 31 formed on an inner face of the connector 33 for engaging the external threads of the barrel 53 of the flanged outlet tube 54.

Figure 3:
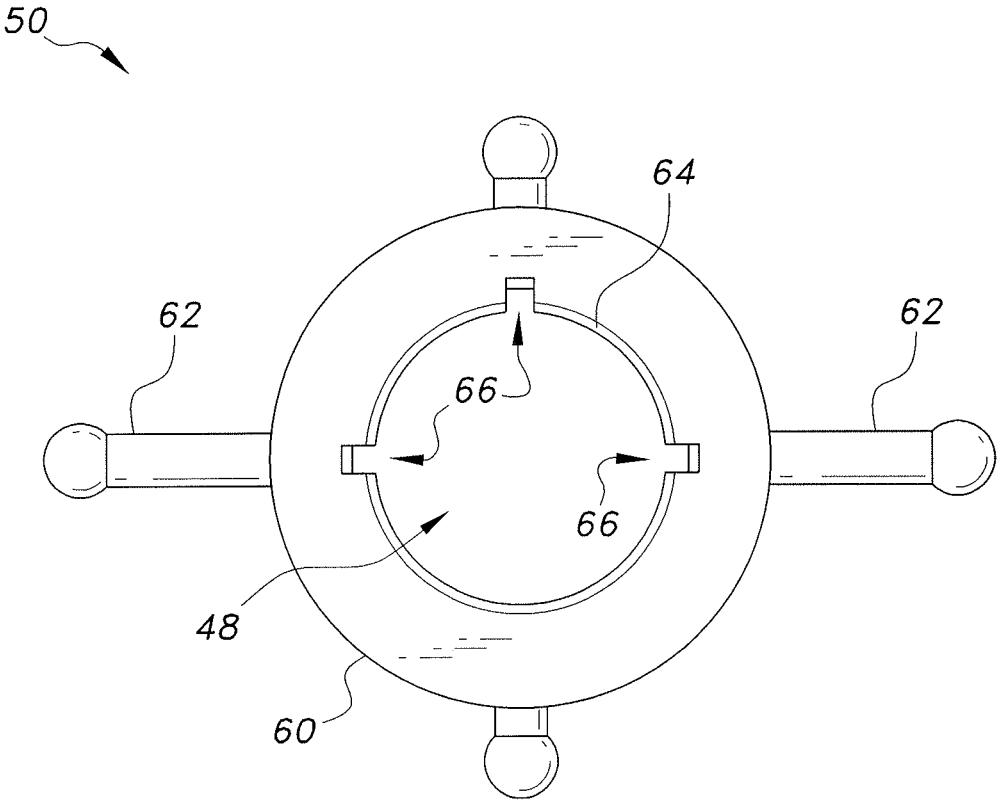
FIG. 3 is a top view of a locking ring of the cap structure of FIG. 2.
Figure 4:
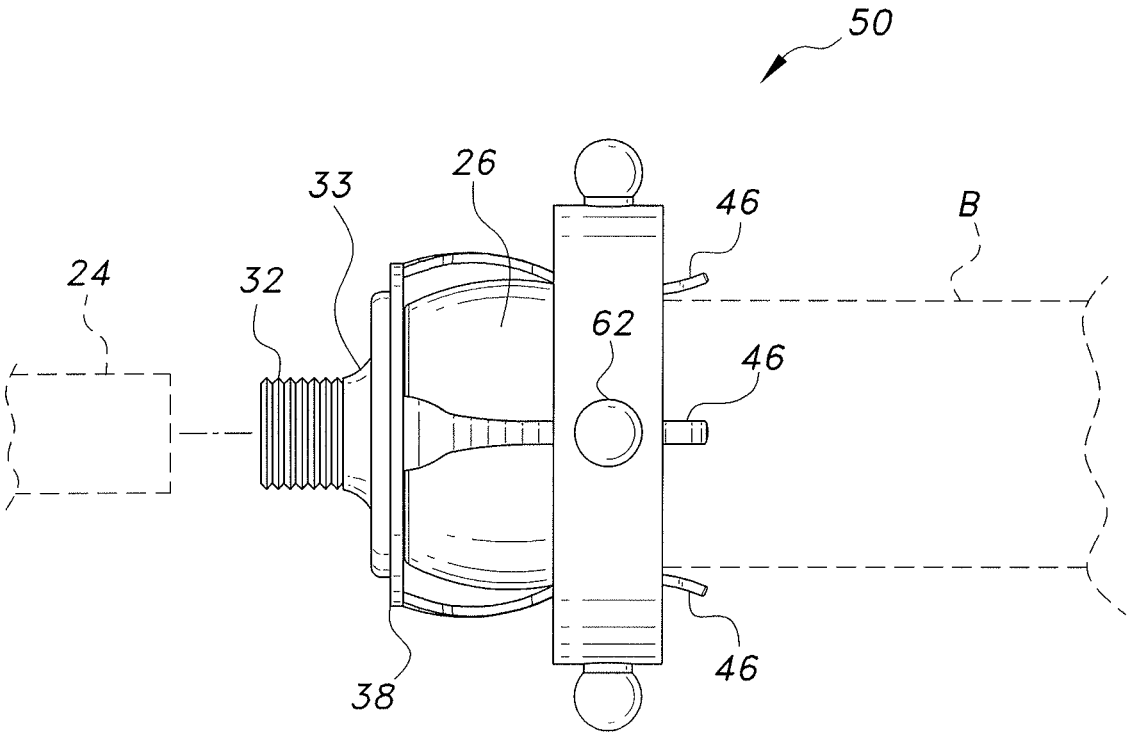
FIG. 4 is an environmental side view of the cap structure of FIG. 2.

An additional locking ring 50 may be used for further securing the clamp 40 and housing 26 against the barrel B of the firearm F. As shown in FIG. 3, the locking ring 50 may include a central ring 60 with at least one handle 62 extending therefrom. In FIG. 3, two such handles 62 are shown. Central ring 60 has a circular opening 48 formed therethrough which is dimensioned to securely receive the barrel B. An inner surface 64 of central ring 60 may include keyways 66 for receiving keys 43 formed on the arms 42 of the clamp 40 to hold the clamp 40 in place, as shown in FIG. 4. Prior to positioning of the clamp 40 and housing 26 over the muzzle end 18 of the barrel B, the locking ring 50 is mounted on the barrel B with the barrel B extending through the opening 48, as illustrated in FIG. 2. Then, the arms 42 of clamp 40 may be slid through the ring 60 until the keys 43 (which may gradually taper outward from the arms 42) on the ends 46 of the arms 42 frictionally engage the keyways 66, locking the cap on the barrel B. As shown in FIG. 2, the free ends 46 of arms 42 may arch outwardly, thus allowing the free ends 46 to be releasably locked to the locking ring 50. The clamp arms 42 are preferably formed from a flat resilient material, such as spring steel, allowing the free ends 46 to be pinched by the user to releasably insert the arms 42 through the ring 60 until the keys 43 engage the keyways 66. Once assembled, as shown in FIG. 4, the return tube 24 may be releasably connected to the hose connector 33, and the clamp 40 and locking ring 50 hold the housing 26 securely, in a fluid-tight manner, against the barrel B. It will be noted in FIG. 4 that the housing 26 and hose connecter 33 encapsulate the muzzle end 18 of the barrel B of the firearm F so that the crown of the rifle is also ultrasonically cleaned by the system 10.

Figure 5:
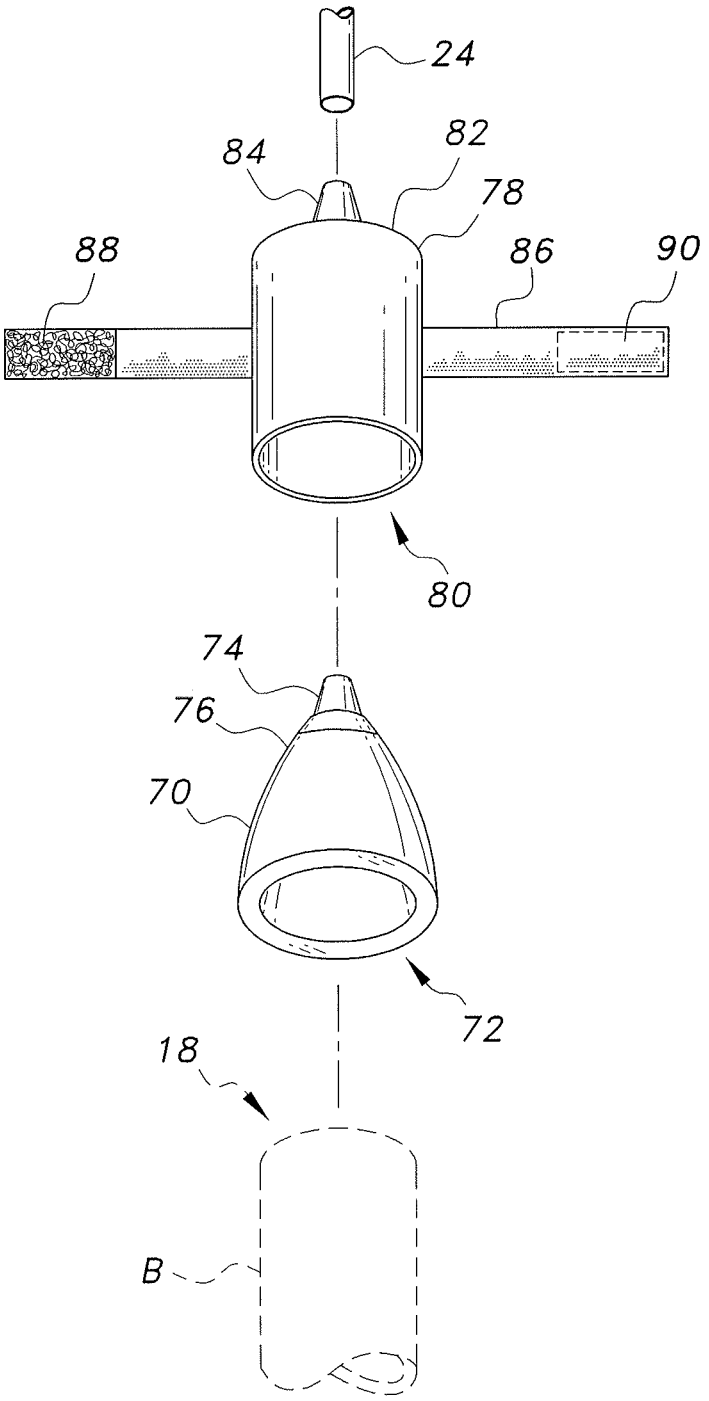
FIG. 5 is an exploded perspective view of an alternative embodiment of the cap structure.

In the alternative embodiment of FIG. 5, the cap structure 16 is replaced by an alternative inner cover 70 and outer cover 78. Similar to housing 26, inner cover 70 has an open end 72 and an opposed closed end 76. The open end 72 is adapted for mounting on the muzzle end 18 of the barrel B, and an outlet port 74 is mounted on the closed end 76. Rather than being secured to the barrel B by a clamp, as in the previous embodiment, the inner cover 70 is held to barrel B by the outer cover 78, which fits over and around the inner cover 70. Similar to the inner cover 70, the outer cover 78 has an open end 80 and an opposed closed end 82, and an outlet connector 84 mounted on the closed end 82. The outlet port 74 of the inner cover 70 aligns with the outlet connector 84 of the outer cover 78 for releasable connection with the return tube 24. Similar to the housing 26, the inner cover 70 and the outer cover 78 may each be formed from Delrin®, a thermoplastic manufactured by DuPont Polymers, Inc. of Delaware, or from a natural or synthetic rubber. In addition to resiliently gripping the barrel B, the inner cover 70 and the outer cover 78 may be further secured about the barrel B by an additional strap 86, which may be wrapped around the outer cover 78 and be held in place by any suitable type of releasable fastener, such as, hook and loop fastener patches 88, 90.

Figure 6:
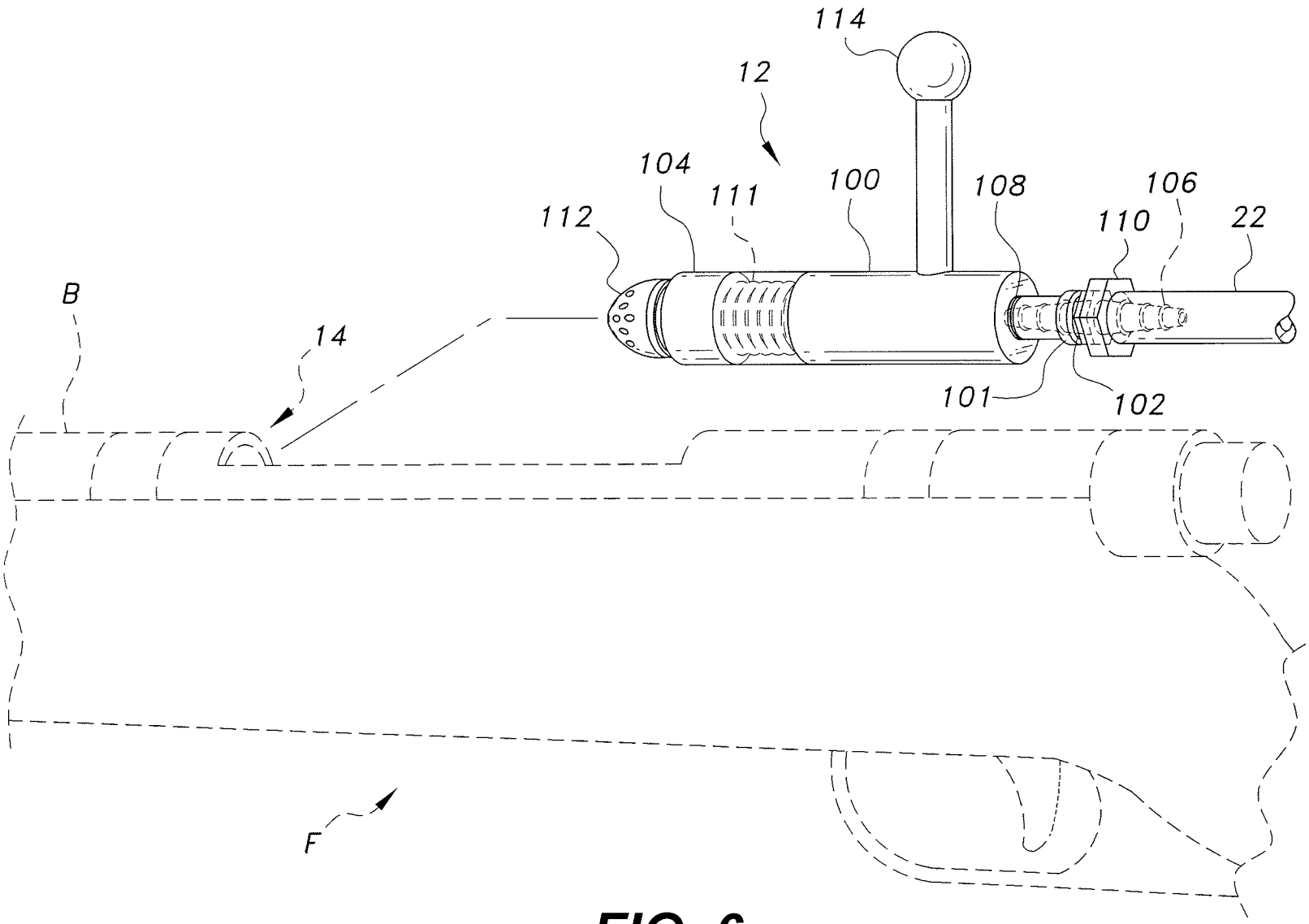
FIG. 6 is a perspective view of a receiver assembly of the firearm cleaning system.

As shown in FIG. 6, the receiver assembly 12 includes a hollow tube 100 having opposed ends 102, 104. The hollow tube 100 may be a spring-loaded telescopic tube, allowing the hollow tube 100 to be adapted to a variety of barrel sizes. It should be understood that helical spring 111 is shown in FIG. 6 for exemplary and illustrative purposes only. Further, it should be understood that the hollow tube 100 may be manufactured in a variety of different lengths and configurations to fit receivers of multiple types of firearms. Further, it should be understood that the hollow tube 100 may also be manufactured with a variety of different diameters, such that the hollow tube 100 may form a fluid tight seal when inserted into the receiver of a particular type of firearm.

The first end 102 terminates in a connector 106 for releasable connection with injection tube 22 from the ultrasonic pump 20. First end 102 may also include threads 108, as shown, for releasable connection with a turn lock or knob 110, allowing fine adjustment of tension on the spring. A nozzle 112, which may be tapered, is disposed at the second end 104 for injecting the cleaning fluid delivered by injection tube 22 from pump 20. The second end includes a hollow sleeve 104, which urges the nozzle 112 to enter the opening of the bore defined by the barrel B and acts in a manner similar to a flange disposed around the nozzle to seal the nozzle 112 in the bore of the rifle. Alternatively, the nozzle 112 may have an integral annular flange. The opening to the bore may include the firing chamber, so that the firing chamber is also ultrasonically cleaned by the system, the nozzle 112 being inserted into and sealed against the opening to the firing chamber. Handle 114, which is attached to the hollow tube 100, is used to compress the spring 111, retracting the hollow sleeve 104 from the nozzle 112 to fit the receiver assembly 12 into the bolt channel of the firearm receiver. The normal spring-loading biases the hollow sleeve 104 and nozzle 112 outward, pushing the nozzle 112 into the bore and sealing the sleeve 104 around the nozzle 112, the handle 114 locking in the firearm receiver's locking mechanism, normally used by the handle of a bolt action in a bolt-action rifle, in order to maintain the nozzle 112 sealed to the barrel B, the knob 110 permitting fine adjustment of the tension applied by the spring 111 to the sleeve 104 and nozzle 112. The nozzle 112 and the hollow sleeve 104 providing the seal around the nozzle 112 may be removably mounted on the receiver assembly 12 and replaced by nozzle/hollow sleeve assemblies of different sizes to accommodate rifle bores of different diameter or caliber.

Additionally, an ultrasonic transducer 101 is mounted on hollow rod 100. Although the ultrasonic transducer 101 is shown as an annular transducer surrounding the first end 102, it should be understood that the ultrasonic transducer 101 may be positioned in any suitable location on the hollow tube 100. In use, the bolt is removed from the receiver of a bolt-action rifle F. The injection tube 22 is connected to the connector 106 of the receiver assembly 12, the nozzle 112 is inserted into the bore of barrel B in the receiver channel, and the handle 114 is pulled toward the first end 102, compressing the spring 111 to fit the receiver assembly 12 into the receiver channel, then released so that spring-loading seals the hollow sleeve 104 and nozzle 112 against the bore to be cleaned. Fine adjustment knob 110 may be rotated to adjust spring tension, if needed, and the handle 114 may be locked against the receiver to maintain the tension. Either cap structure 16 or the alternative inner and outer covers 70, 76, as described above, are used to cover second end 18 of barrel B, and are connected to return tube 24. Pump 20 injects ultrasonic cleaning fluid through injection tube 22, hollow tube 100 and nozzle 112 to fill the interior of the barrel B. The pump 20 may be paused and the ultrasonic transducer 101 may be activated or switched on and off, either manually or under automatic control by a microcontroller or other processor, to induce cavitation for one or more ultrasonic cleaning cycles. The used cleaning fluid is then sucked from the barrel B by pump 20 through return tube 24 for filtering and recirculation by the pump. The cap structure 16 may then be removed from barrel B, and the receiver assembly 12 may be removed from the receiver and replaced with the bolt.

Figure 7:
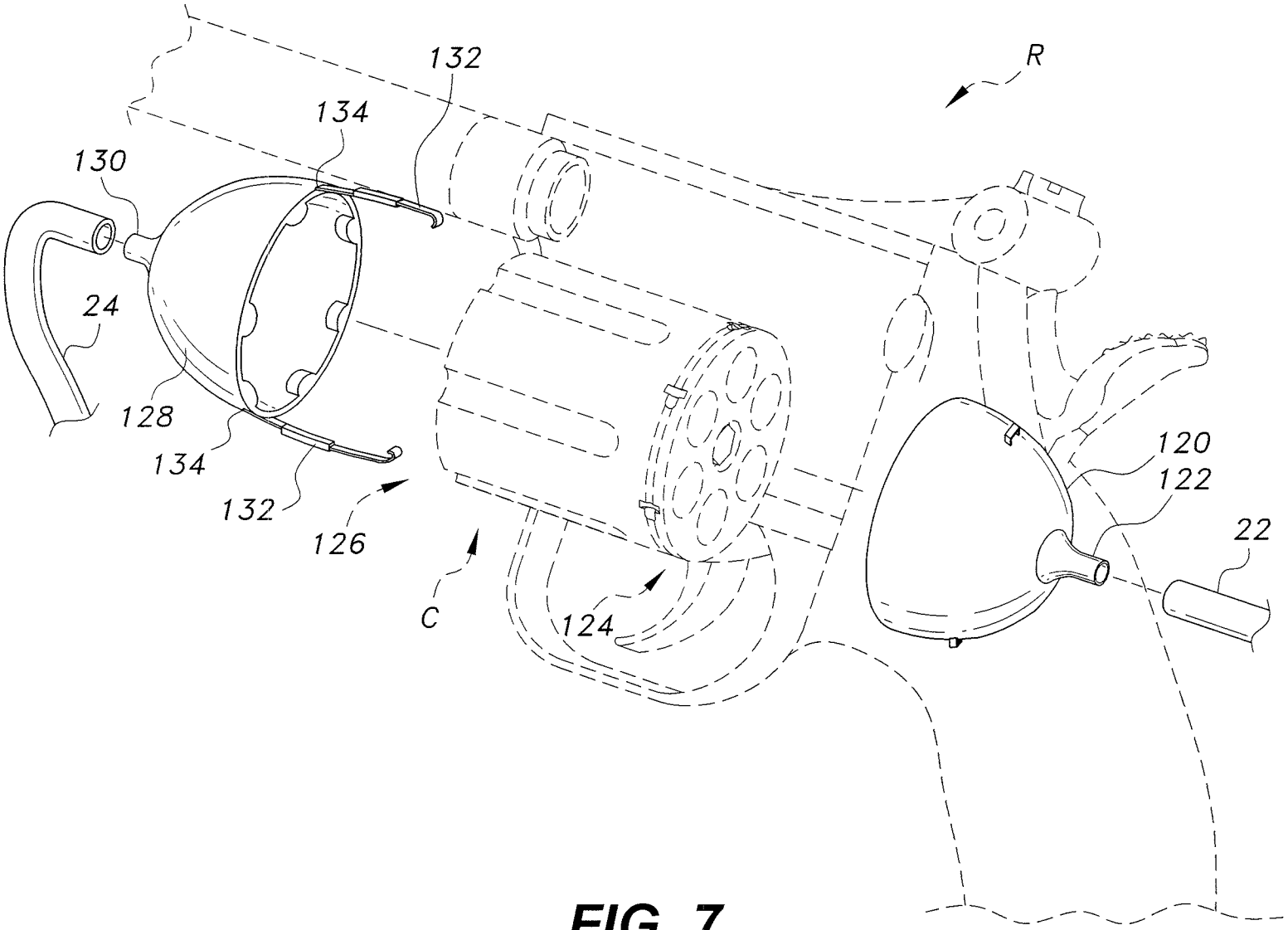
FIG. 7 is an exploded, environmental perspective view of an additional accessory for cleaning a cylinder of a revolver.

FIG. 7 shows an additional accessory for cleaning the cylinder C of a revolver R. Pump 20, injection tube 22 and return tube 24 from the previous embodiment may each be used in a similar manner. However, the injection tube 22 connects to an injection manifold 120 via a nipple 122, which is placed against a first end 124 of the cylinder C. Return tube 24 connects to a suction cap 128 via a connector 130. The suction cap 128 is mounted on the second end 126 of cylinder C. Locking arms 132 are pivotally attached to the suction cap 128 via hinges or pivots 134 for releasably sealing the suction cap 128 to the cylinder C, and also for engaging the injection manifold 120 to releasably seal the injection manifold 120 to the cylinder C.

Similar to the above, in use, injection tube 22 is connected to injection manifold 120 via a nipple 122, and return tube 24 is connected to suction cap 128 via connector 130. The locking arms 132 are pivoted to lock suction cap 128 to the second end 126 of the cylinder C, and to lock the injection manifold 120 against the first end 124 of the cylinder C. Pump 20 injects cleaning fluid through injection tube 22 and the injection manifold 120 to clean the interior of the chambers of the cylinder C. The used cleaning fluid is then sucked from the chambers of cylinder C by pump 20, through return tube 24. Similar to the above, an ultrasonic transducer, similar to transducer 101, is also used to provide for ultrasonic cleaning of the chambers of the cylinder C.

It is to be understood that the firearm barrel cleaning system is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A firearm barrel cleaning system, comprising:

a receiver assembly, the receiver assembly consisting of:

a) opposed first and second ends, the first end being adapted for receiving a stream of ultrasonic cleaning fluid, the second end having a removable nozzle adapted for insertion within a receiver of the firearm and sealing against an opening of a bore defined in a barrel of the firearm and ejecting the stream of cleaning fluid within the barrel;

b) a hollow telescoping tube including:

i) a hollow sleeve disposed at the second end of the receiver assembly;

ii) a bias spring disposed inside the hollow telescoping tube, the bias spring biasing the hollow sleeve to bear against the removable nozzle, urging the removable nozzle outward and configured to seal the removable nozzle against the opening of the bore defined by the barrel of the firearm; and iii) a handle extending from the hollow telescoping tube, the handle compressing the bias spring and retracting the removable nozzle when pulled opposite the removable nozzle to aid insertion of the receiver assembly into the firearm receiver, the handle being adapted for locking against the firearm receiver to keep the removable nozzle sealed against the opening of the bore defined by the firearm;

c) an ultrasonic transducer mounted on the hollow telescoping tube;

d) a tension adjustment knob mounted on the hollow telescoping tube for adjusting tension of the bias spring; and e) a connector at the first end of the receiving assembly for receiving the stream of ultrasonic cleaning fluid;

a cap structure having a hose connector, the cap structure being adapted for releasably covering and sealing a muzzle end of the barrel of the firearm; and a recirculation pump for selectively circulating the ultrasonic cleaning fluid through the receiver assembly, the barrel of the firearm, and out of the muzzle end of the barrel through the hose connector of the cap structure;

whereby the barrel of the firearm may be cleaned from firing chamber to crown by pausing the recirculation pump and switching the ultrasonic transducer on and off to induce cavitation of the ultrasonic cleaning fluid for at least one cleaning cycle.

2. The firearm barrel cleaning system as recited in claim 1, further comprising:

an injection tube connecting the recirculation pump and the receiver assembly; and a return tube connecting the recirculation pump and the cap structure.

3. The firearm barrel cleaning system as recited in claim 1, wherein said removable nozzle further comprises an annular flange adapted for sealing the removable nozzle against the opening of the bore defined in the barrel of the firearm.

4. The firearm barrel cleaning system as recited in claim 1, wherein the cap structure comprises:

a housing having opposed open and closed ends, the open end thereof being dimensioned and configured for mounting about the muzzle end of the barrel of the firearm, the closed end having an aperture formed therein; and an outlet tube having an annular flange sealing the closed end of the housing and a barrel extending through the aperture coaxially with the hose connector.

5. The firearm barrel cleaning system as recited in claim 4, further comprising a check valve disposed in the barrel of said outlet tube.

6. The firearm barrel cleaning system as recited in claim 5, wherein the cap structure further comprises a clamp releasably securing the housing against the muzzle end of the barrel of the firearm.

7. The firearm barrel cleaning system as recited in claim 6, wherein the clamp comprises:

a ring abutting the closed end of the housing, the ring having a periphery and a central aperture, the barrel of the outlet tube extending through the central aperture and into the hose connector; and a plurality of resilient legs extending from the periphery of the ring and over the housing, the legs having distal ends adapted for bearing against the barrel of the firearm.

8. The firearm barrel cleaning system as recited in claim 7, further comprising a locking ring having:

an annular body having a periphery and a central circular opening;

a plurality of handles extending from the periphery of the annular body; and a plurality of keyways defined in the central circular openings, the distal ends of the legs of said clamp having sloping keys extending therefrom, the annular body being dimensioned and configured for placing over the muzzle end of the barrel of the firearm, the locking ring being pulled upward over the distal ends of the legs of said clamp with the sloping keys resiliently engaging the keyways to secure said clamp to the barrel of the firearm.

9. The firearm barrel cleaning system as recited in claim 8, wherein the housing of said cap structure is made from a resilient polymer.

* * * * *